US011930892B2

(12) United States Patent
Poston

(10) Patent No.: US 11,930,892 B2
(45) Date of Patent: Mar. 19, 2024

(54) DEVICE FOR RETAINING A STRAP WITHIN A TENSIONING DEVICE

(71) Applicant: VisumLearn, Inc., Hampton, TN (US)

(72) Inventor: Phillip A Poston, Hampton, TN (US)

(73) Assignee: VisumLearn, Inc., Hampton, TN (US)

( * ) Notice: Subject to any disclaimer, the term of this patent is extended or adjusted under 35 U.S.C. 154(b) by 0 days.

(21) Appl. No.: 18/050,145

(22) Filed: Oct. 27, 2022

(65) Prior Publication Data

US 2023/0270214 A1 Aug. 31, 2023

Related U.S. Application Data

(60) Provisional application No. 63/268,613, filed on Feb. 28, 2022.

(51) Int. Cl.
*A44B 11/06* (2006.01)

(52) U.S. Cl.
CPC ..... *A44B 11/06* (2013.01)

(58) Field of Classification Search
CPC ... A44B 11/06; F16B 2/065; Y10T 24/44974; Y10T 24/4016; Y10T 24/44752; A61B 17/1227
See application file for complete search history.

(56) References Cited

U.S. PATENT DOCUMENTS 2,197,656 A * 4/1940 Buchsbaum ..... A44B 11/12 24/170
3,646,644 A * 3/1972 Watts ..... B60R 22/19 242/380
4,115,906 A * 9/1978 Lavine ..... A41F 17/04 24/72.1
4,487,205 A * 12/1984 Di Giovanni ..... A61B 17/122 251/10
4,716,886 A * 1/1988 Schulman ..... A61B 17/122 606/167
4,754,534 A * 7/1988 Helwick ..... A44C 5/2095 63/3.2
4,897,900 A * 2/1990 Baggett ..... A41B 15/02 24/543
5,062,846 A * 11/1991 Oh ..... A61B 17/122 606/158
5,257,525 A * 11/1993 Clarke ..... B21D 39/046 72/402

(Continued)

*Primary Examiner* — Robert Sandy
*Assistant Examiner* — Rowland Do
(74) *Attorney, Agent, or Firm* — Sheri Higgins; Sheri Higgins Law, PLLC

(57) ABSTRACT

A retention device can be used with an adjustable strap. The adjustable strap can be part of a tie down strap system, a backpack, or a fanny pack. A free end of the adjustable strap can be inserted and pulled through a tensioning device. The retention device can be placed around a portion of the adjustable strap adjacent to the tensioning device. The retention device can prevent the adjustable strap from undesirably pulling back through the tensioning device. The retention device can include a top plate and bottom plate that sandwich the strap and then connected to each other. The retention device can also be a strip of material that includes a plurality of tiny loops and a plurality of tiny flexible hooks that are used to attach to the adjustable strap and wrap around the strap.

15 Claims, 9 Drawing Sheets

(56) References Cited

U.S. PATENT DOCUMENTS 5,598,608 A * 2/1997 Naslund ..... B65D 33/1675 24/30.5 R
5,653,003 A 8/1997 Freeman
5,937,745 A * 8/1999 Boe ..... H02G 3/26 100/2
5,950,284 A 9/1999 Persson
6,434,803 B1 * 8/2002 Spong ..... A47G 25/145 24/30.5 R
6,460,231 B2 * 10/2002 Bourgerie ..... F16M 13/02 24/518
7,004,547 B1 * 2/2006 Cheng ..... B60R 22/19 297/483
7,171,731 B1 2/2007 Borcherding
7,181,806 B2 * 2/2007 Folkmar ..... B65D 33/1675 24/30.5 R
7,240,405 B2 * 7/2007 Webber ..... A44B 11/2557 24/194
7,428,771 B2 * 9/2008 Fujii ..... B65D 81/3266 24/30.5 R
7,694,918 B2 * 4/2010 Zhang ..... B30B 15/00 248/65
8,079,116 B2 12/2011 Ayers
8,146,946 B1 * 4/2012 Emond ..... B60R 22/30 297/483
8,250,717 B2 8/2012 Boone
8,393,645 B2 * 3/2013 Wiseman ..... B60R 22/19 280/808
8,695,175 B2 * 4/2014 Pi ..... B60R 22/30 24/200
8,746,742 B2 * 6/2014 Heath ..... B60R 22/19 280/808
8,782,860 B2 * 7/2014 Rogers ..... A43C 7/005 24/336
9,004,536 B2 4/2015 Heath
9,596,907 B2 * 3/2017 Yang ..... A44B 11/12
9,878,654 B2 1/2018 Martinsen
10,076,161 B2 * 9/2018 Walden ..... A44B 11/12
10,830,375 B1 * 11/2020 Djrbashian ..... H05K 3/325
11,091,085 B2 8/2021 Chen et al.
11,639,759 B2 * 5/2023 Itokazu ..... F16M 13/02 248/68.1
2007/0193004 A1 8/2007 Chou
2010/0282795 A1 * 11/2010 Wrigley ..... A45F 3/00 248/74.1
2011/0046437 A1 * 2/2011 Kassab ..... A61F 5/0013 606/157
2013/0298354 A1 * 11/2013 Campbell ..... B60R 22/024 24/191

* cited by examiner

DEVICE FOR RETAINING A STRAP WITHIN A TENSIONING DEVICE

TECHNICAL FIELD

The field relates to straps and a retention device that prevents a loose end of a strap from undesirably dislodging from a tensioning device. The retention device can include a top plate and bottom plate that matingly engage with the strap to prevent the strap from feeding through the tensioning device.

BRIEF DESCRIPTION OF THE FIGURES

The features and advantages of the embodiments will be more readily appreciated when considered in conjunction with the accompanying figures. The figures are not to be construed as limiting any of the embodiments.

DETAILED DESCRIPTION

There are a variety of devices that utilize an adjustable strap that is inserted through a tensioning device to keep the strap adjusted at a desired length. Examples include tie down straps, backpacks, and fanny packs to name a few.

A tie down strap, also called a ratchet strap, lashing strap, or tie down, can be used in a variety of industries and for personal use. A tie down strap is a type of fastener that is used to secure objects, for example during transport, from significant movement. Tie down straps can be used to secure cargo during transport, for example on a flat-bed trailer, a moving van, or a personal vehicle. Tie down straps can also be used to secure objects in a building, such as a barn or warehouse.

Figure 1:
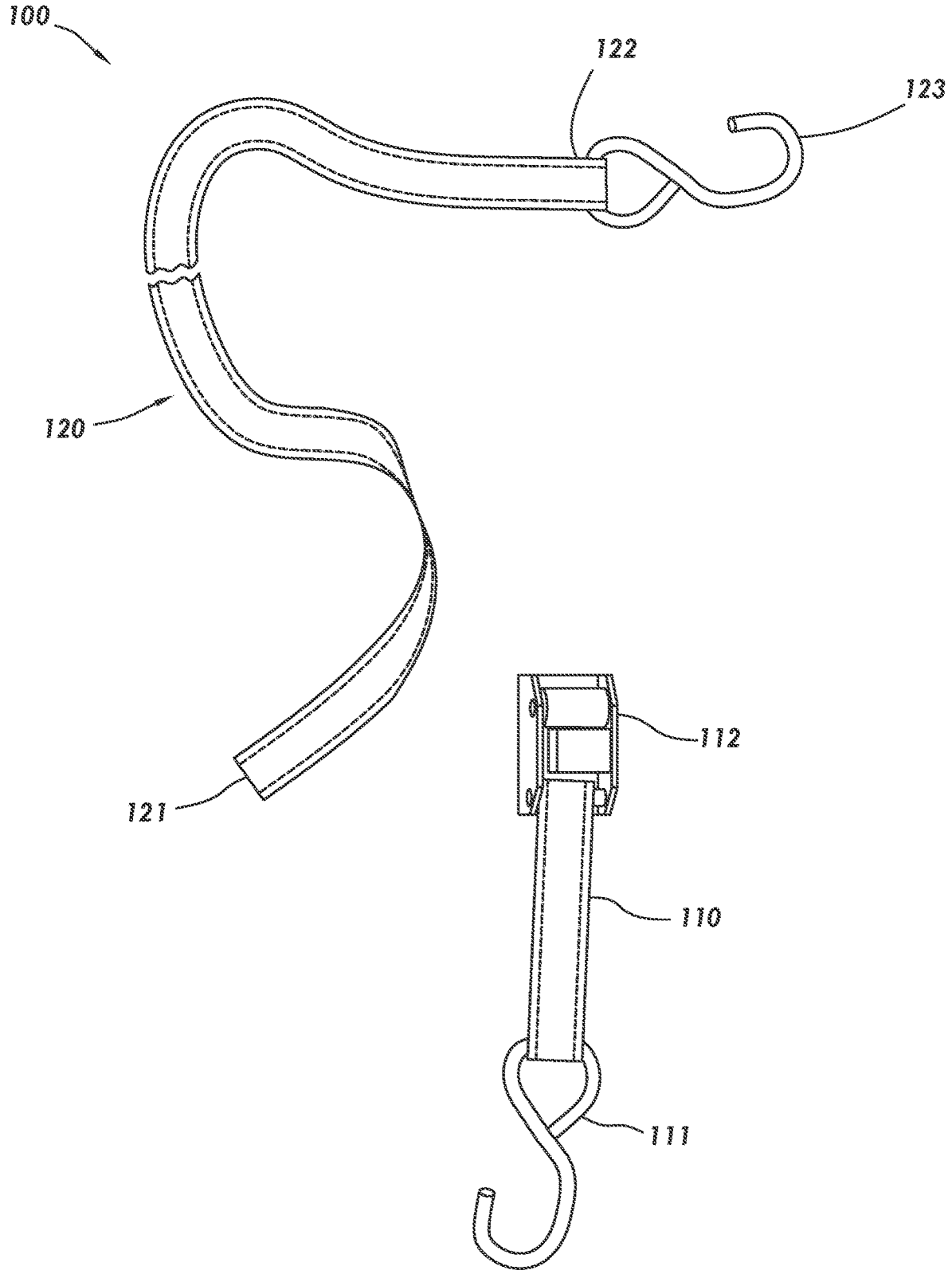
FIG. 1 illustrates the components of a tie down strap with a second strap being separate from a tensioning device according to certain embodiments.
Figure 2:
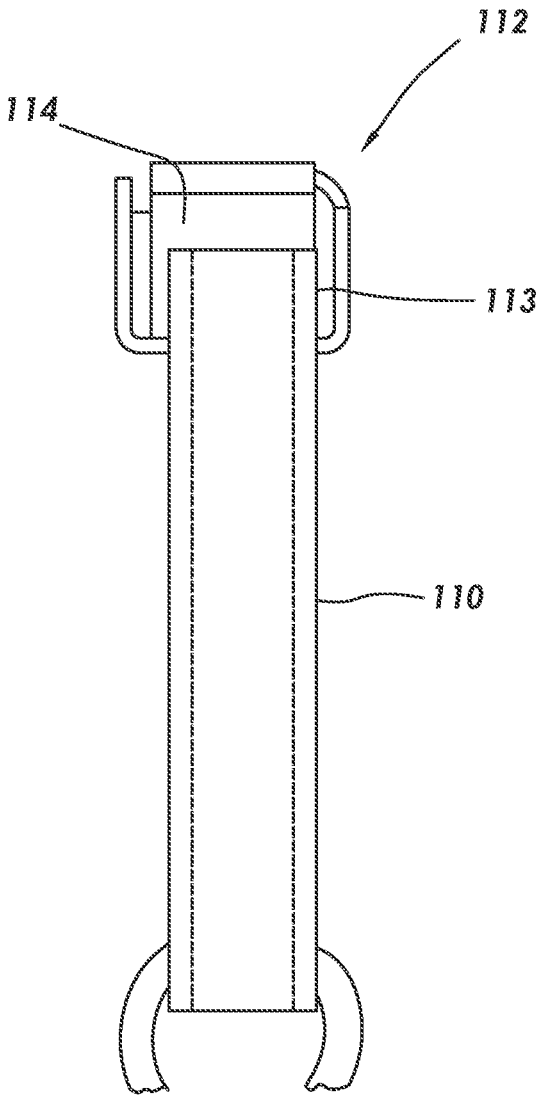
FIG. 2 illustrates the tie down strap of FIG. 1 showing a first strap and the tensioning device in more detail.
Figure 3:
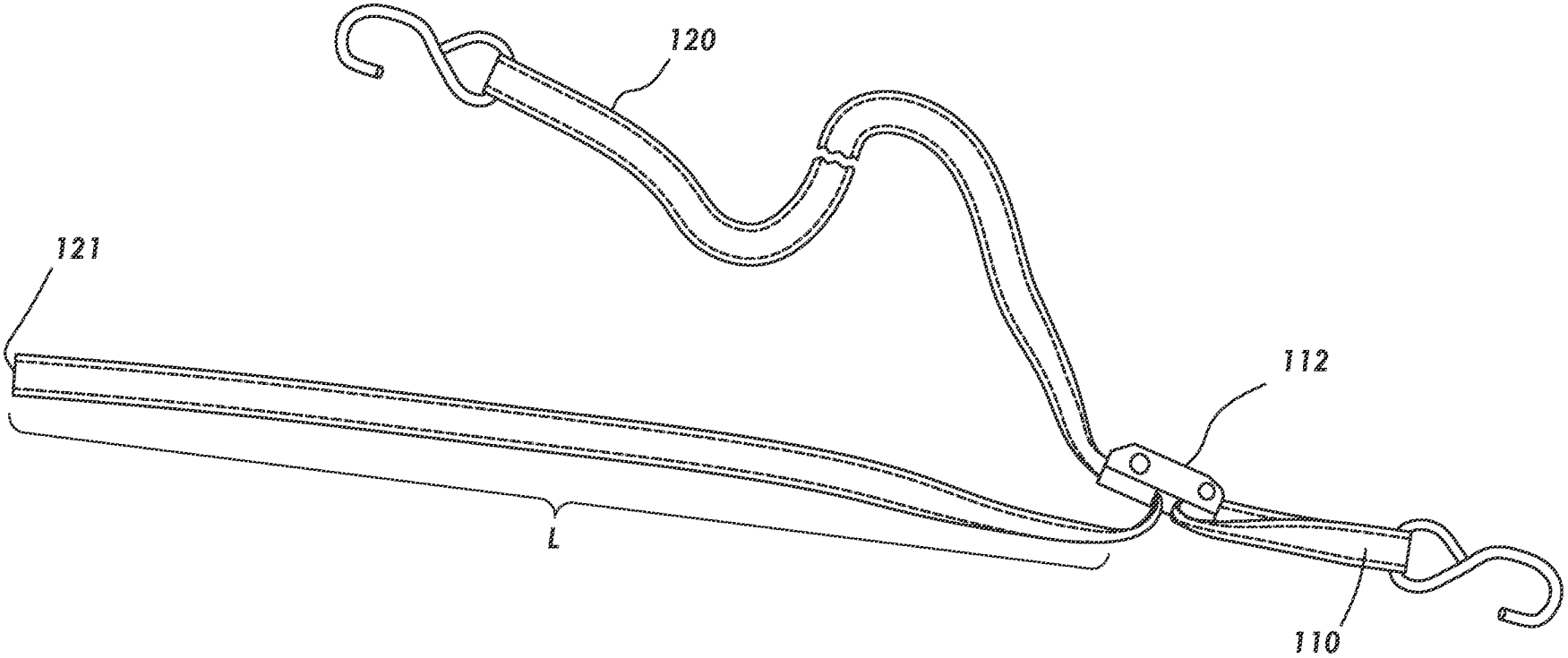
FIG. 3 illustrates the tie down strap of FIG. 1 showing the second strap after insertion into the tensioning device.

A two-piece tie down strap generally includes two separate straps made of a high strength, webbed material and tie down hardware. The tie down hardware can be, for example, a cam or ratchet. FIGS. 1-3 show an example of a two-piece tie down strap system 100. It is to be understood that the tie down strap system shown in FIGS. 1-3 is just one example of a two-piece tie down strap 100 and is not meant to exclude other configurations of tie down straps that are commonly used. The tie down strap 100 can include a first strap 110 that is permanently connected at one end 113 to a tensioning device 112. The other end of the first strap 110 can be connected to an anchor 111. The anchor 111 can be, for example, a J hook, D hook, or S hook (as shown in the drawings). The tensioning device 112 can be a cam or a ratchet, for example as shown with the tie down strap 100. The tie down strap 100 can also include a second strap 120 that is an adjustable strap. The adjustable strap 120 can include an anchor 123 permanently attached to a second end 122. The first end 121 or free end of the adjustable strap 120 does not include any permanent attachments and is designed to be inserted into and removable from the tensioning device 112 (shown in FIG. 1 as being removed and separated from the tensioning device 112). As used herein, the phrase "free end" in relation to a strap means any end that is not permanently attached to an object and can be inserted into and removed from a tensioning device.

As shown in FIGS. 2 and 3, in order to secure objects, the first end 121 of the adjustable strap 120 is inserted into an opening 114 within the tensioning device 112. The first end 121 of the adjustable strap 120 can be pulled through the tensioning device 112 such that a desired length L of the adjustable strap 120 extends past the tensioning device 112. After the first end 121 of the adjustable strap 120 is inserted through the tensioning device 112, the anchor/hook 111 on the first strap 110 can be attached to an area on one side of the object to be secured, the adjustable strap 120 can be positioned over the object, and the anchor/hook 123 on the adjustable strap 120 can be attached to an area on the other side of the object.

Generally, there will be an excess of the adjustable strap 120 laying over the object. Therefore, the first end 121 of the adjustable strap 120 can be pulled through the tensioning device 112 until the adjustable strap 120 is taut against the object. The tensioning device 112 can then be used to ratchet up the first and second adjustable straps thereby creating more tension across the object to be secured and reduce the chances of the object moving during transport.

Figure 4A:
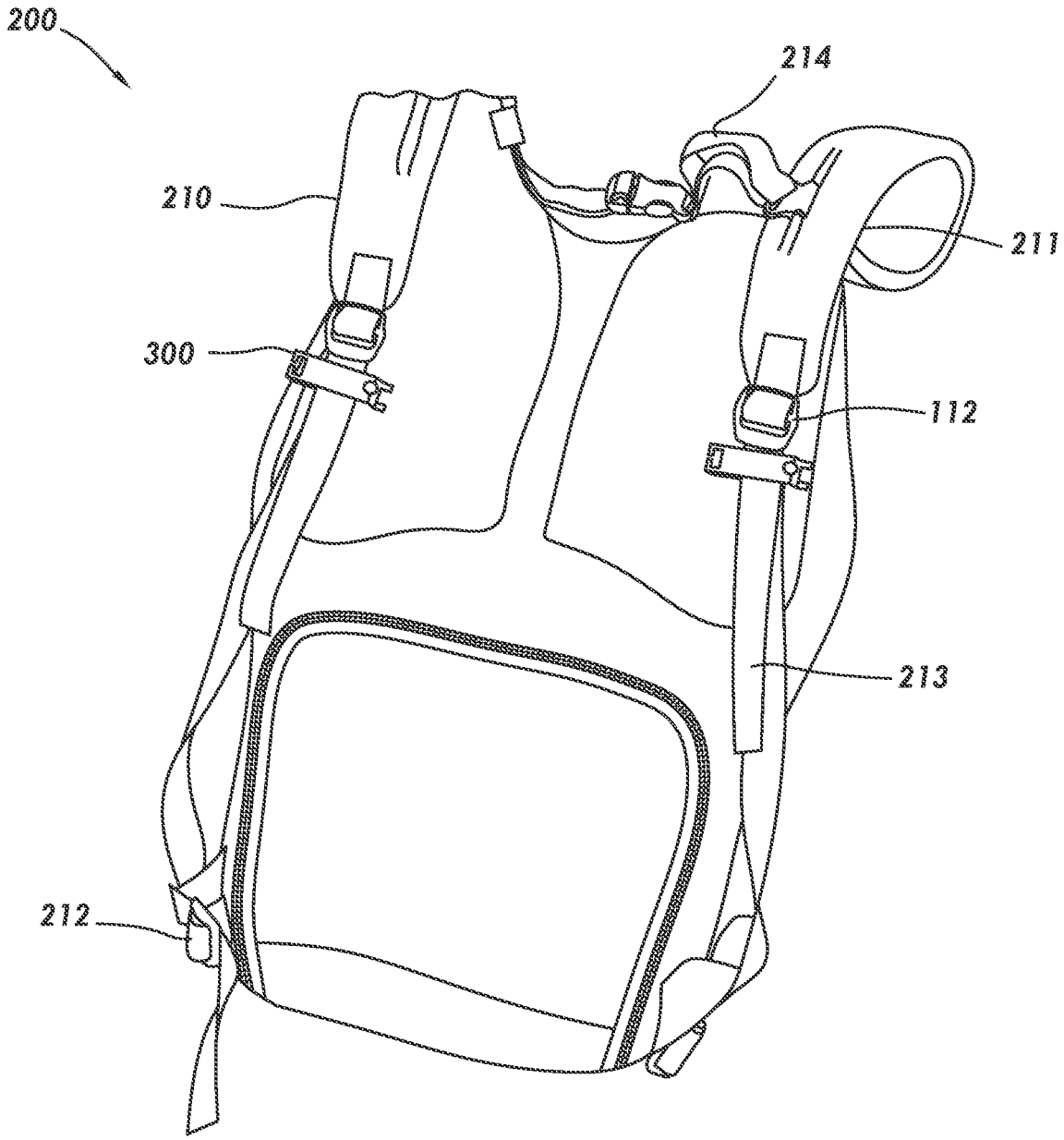
FIG. 4A is perspective view of a backpack with a retention device used on the shoulder straps according to certain embodiments.
Figure 4B:
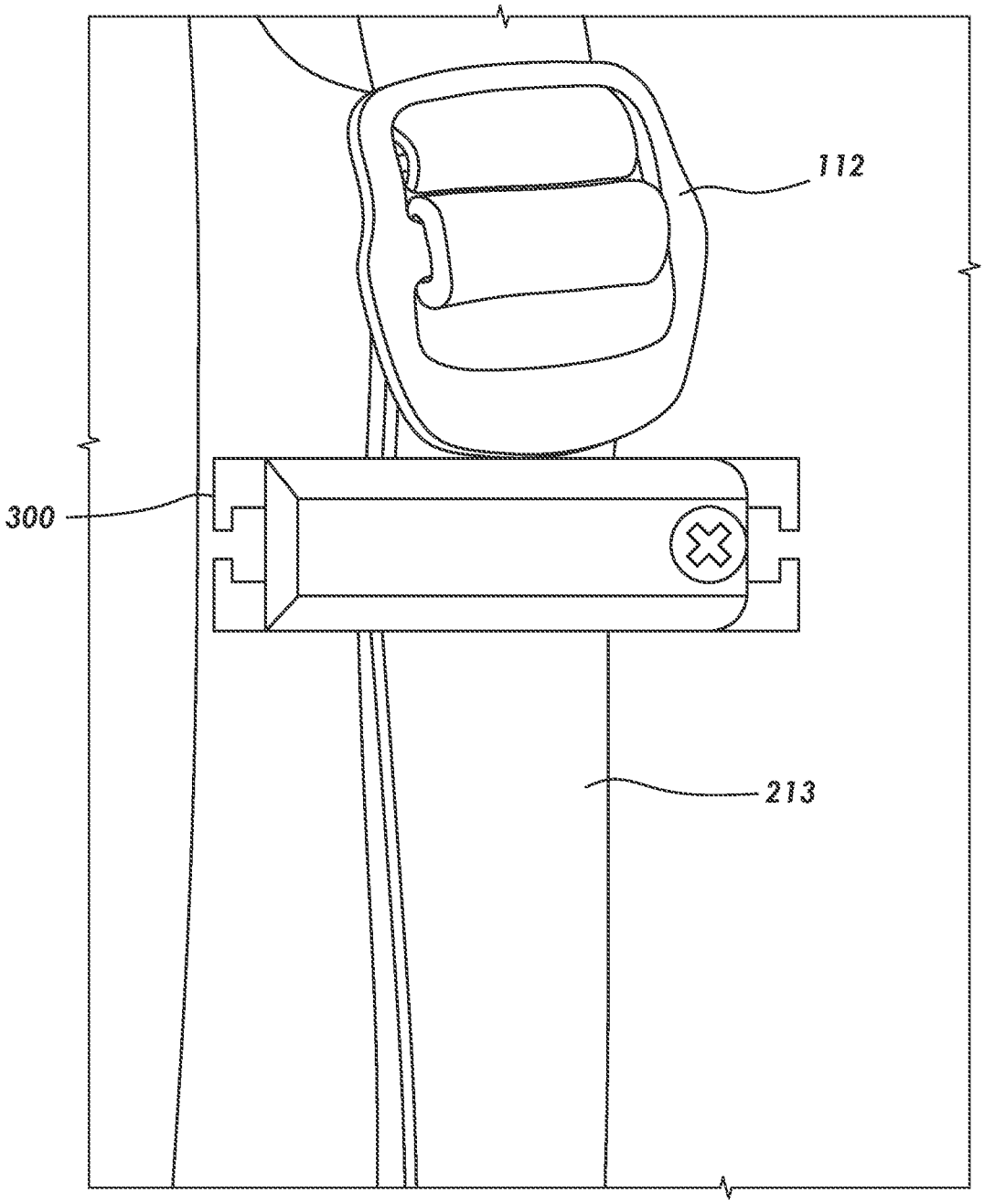
FIG. 4B is an enlarged view of the retention device of FIG. 4A.

FIGS. 4A and 4B show another device that utilizes a tensioning device to adjust the length of a strap. A backpack 200 includes two shoulder straps 210 on a back side of the backpack. The shoulder straps 210 generally include a first padded strap 211 that is permanently attached at one end to the top of the backpack 200 and has a tensioning device 112, commonly called a ladder lock buckle, permanently attached to the other end. The backpack 200 also includes a second, adjustable strap 212 that is permanently attached at one end to a bottom of the pack and has a free end 213 at the opposite end. The free end 213 of the adjustable strap 212 is inserted into the tensioning device 112 and the free end 213 is pulled a desired length through of the tensioning device 112 in order to adjust the length of the straps for desired placement of the backpack on a user's back. A backpack 200 can also include a wide variety of other components, such as pockets, waist belts, liners, or sternum straps 214. Many other products, such as fanny packs, belt bags, and cross-body bags, utilize a tensioning device to adjust the length of straps.

However, there are problems that can arise when trying to maintain the length of straps through a tensioning device after adjusting the length. By way of example, there is a propensity for the free end of the adjustable strap to undesirably pull loose and dislodge from the tensioning device. Moreover, even tensioning devices that include teeth or other mechanisms that purport to inhibit the adjustable strap from pulling free, with enough force, the strap can still pull through the tensioning device sufficient to create slack in the strap, or in some cases, the strap can pull entirely through the tensioning device. A strap that gets slack in it or pulls completely free wastes time re-adjusting the strap or can also cause frustration because the process of securing the object must begin again. Thus, there is a need for a device that retains an adjustable strap within a tensioning device at a desired location and prevents the adjustable strap from undesirably pulling back through the tensioning device.

It has been discovered that a retention device can be used to retain a strap within a tensioning device. It is to be understood that the retention device can be used with any type of product, such as a tie down strap, backpack, etc. that includes an adjustable strap with at least one free end without being limited to the example tie down straps and backpacks shown in the figures and described above. As used herein, the phrase "adjustable strap" means any strap of a product that has at least one free end (i.e., a first end) that can be used to adjust the length of straps in relation to a tensioning device. The discussion and reference to the straps, backpacks, and tensioning devices are to illustrate placement of the retention device according to any of the embodiments and are not intended to limit the exact types of products the retention device can be used with, or the various embodiments described below.

A retention device for use with an adjustable strap can include: a top plate, wherein the top plate comprises an interior surface and an exterior surface; a bottom plate, wherein the bottom plate comprises an interior surface and an exterior surface, wherein the interior surface of the top plate is configured to receive a first side of a portion of the adjustable strap, wherein the interior surface of the bottom plate is configured to receive a second side of the portion of the adjustable strap; and a connector, wherein the top plate and bottom plate are configured to be connected to each other via the connector to prevent the adjustable strap from pulling through a tensioning device.

According to other embodiments, a retention device for use with an adjustable strap can include: a strip of material, wherein a side of the strip of material comprises: a first end comprising a plurality of tiny loops; a middle portion comprising a plurality of tiny loops; and a second end comprising a plurality of tiny flexible hooks, wherein the plurality of tiny loops of the middle portion are configured to adhere to a plurality of tiny flexible hooks located on a first side of the adjustable strap, wherein the plurality of tiny loops of the first end are configured to adhere to the plurality of tiny flexible hooks of the second end, and wherein after adherence of the middle portion to the adjustable strap and the first end to the second end, the adjustable strap is prevented from pulling through a tensioning device.

Figure 5B:
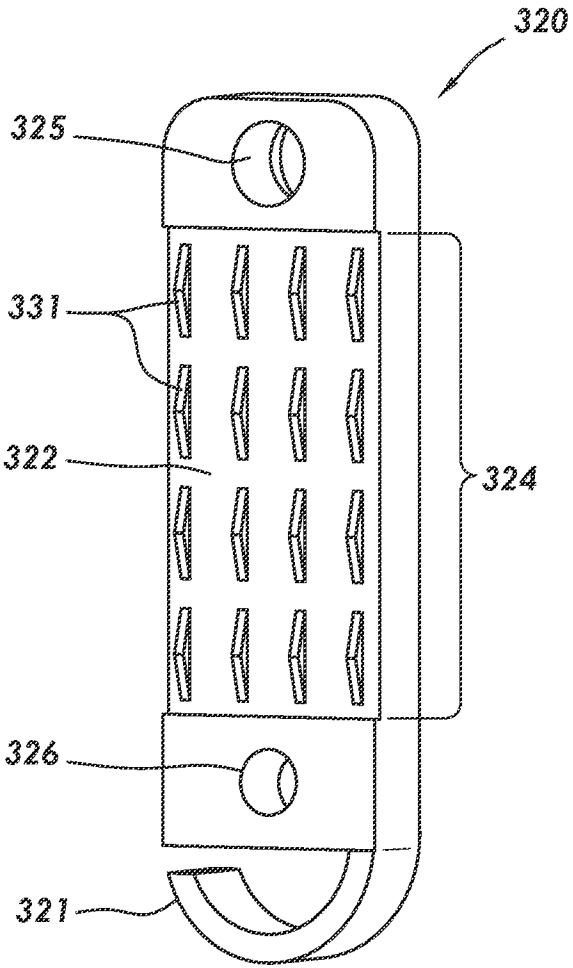
FIGS. 5A and 5B are perspective views of a top plate and bottom plate of the retention device for retaining the second strap within the tensioning device according to certain embodiments.
Figure 5A:
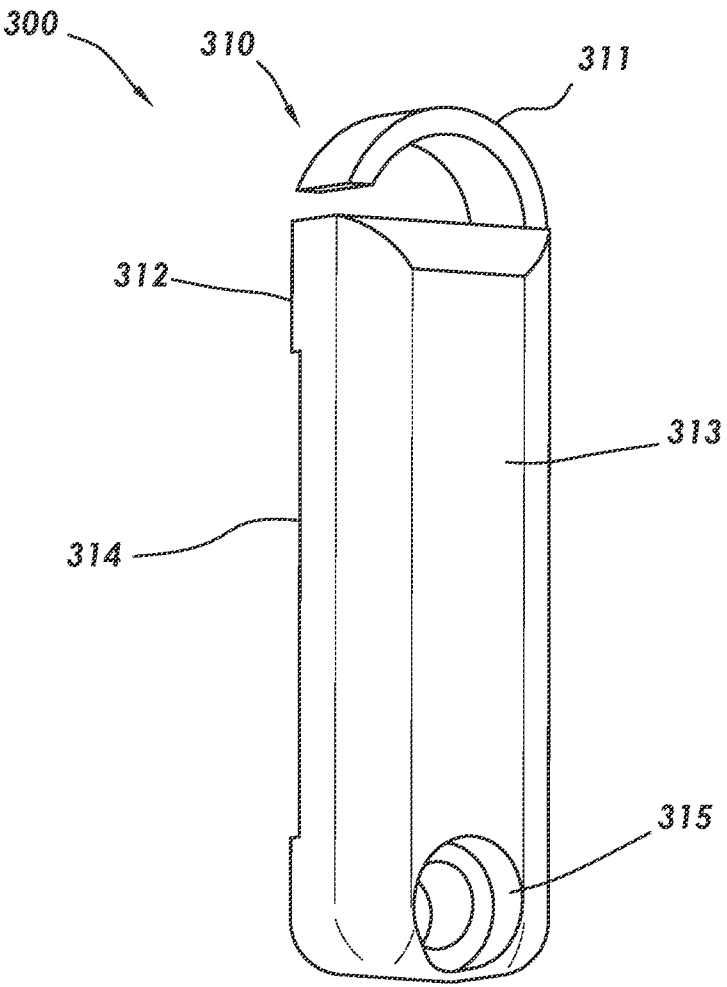
Figure 7:
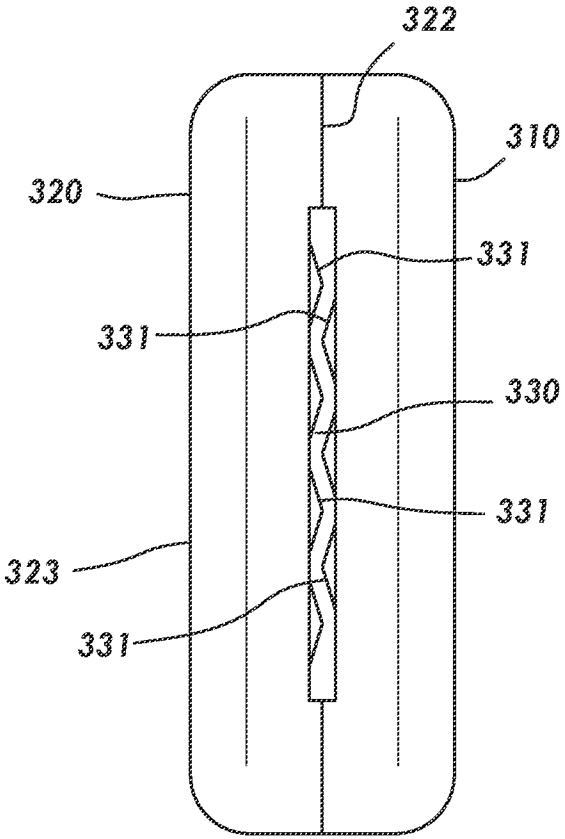
FIG. 7 is a side view of the top plate and bottom plate of the retention device including a plurality of protrusions according to certain embodiments.
Figure 6:
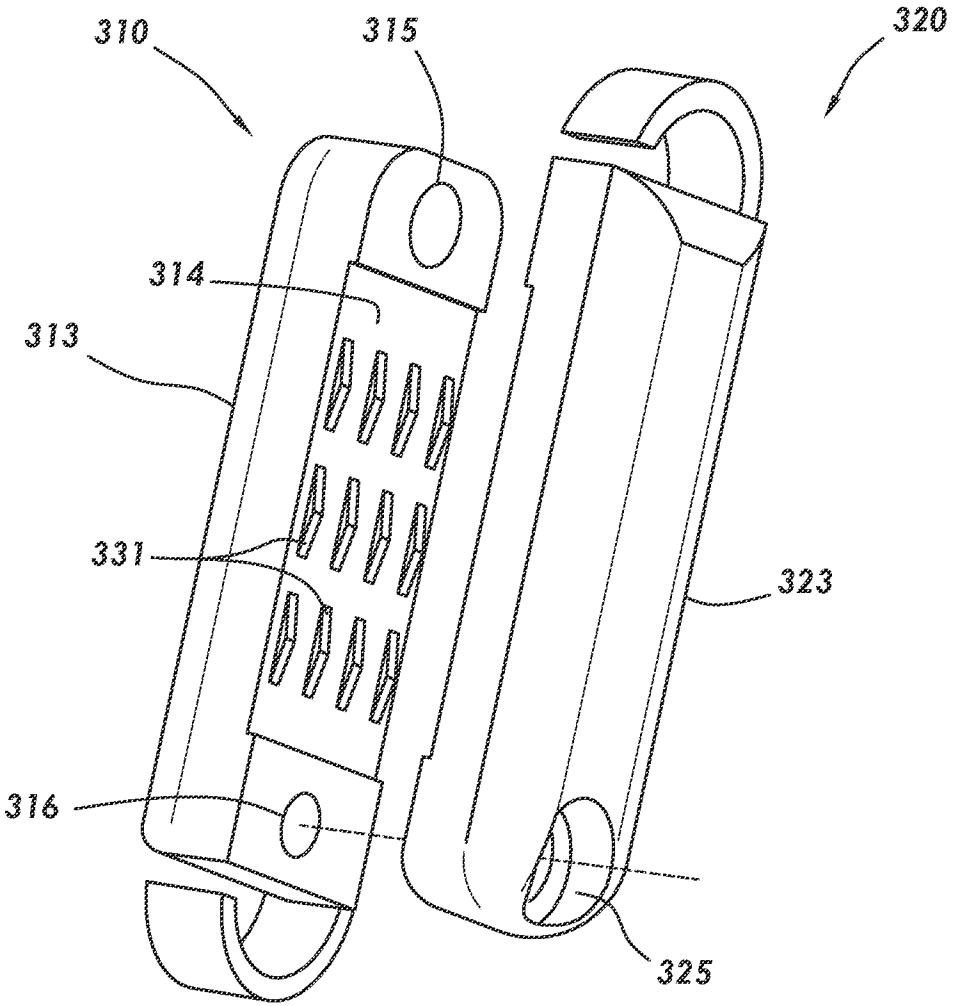
FIG. 6 is a perspective view of the retention device showing the top plate and the bottom plate prior to connection according to certain embodiments.

FIGS. 5-7 show a retention device 300 according to any of the embodiments. The retention device 300 can include two plates. As shown in FIGS. 5A and 5B, the retention device 300 can include a top plate 310 as shown in FIG. 5A and a bottom plate 320 as shown in FIG. 5B. Use of the words "top" and "bottom" are for illustrative orientation purposes only and not meant to require the top plate be on top of the strap as the plates can be reversed.

The top plate 310 can include an interior surface 312 and an exterior surface 313. The bottom plate 320 can include an interior surface 322 and an exterior surface 323. The interior surface 312 of the top plate 310 is configured to receive a first side of a portion of the adjustable strap 120 and the interior surface 322 of the bottom plate 320 is configured to receive a second side of the portion of the adjustable strap 120 (for example, shown in FIG. 8). In this manner, the adjustable strap 120 can be sandwiched between the interior surfaces 312/322 of the top plate 310 and bottom plate 320. The top plate 310 and bottom plate 320 are configured to be connected to each other to prevent the adjustable strap 120 from pulling through a tensioning device, for example, the tensioning device 112 shown in FIGS. 1—4B.

Still with reference to FIGS. 5A-7, the interior surface 312 of the top plate 310 can include a recessed portion 314. The interior surface 322 of the bottom plate 320 can include a recessed portion 324. The recessed portions 314/324 can be located a desired distance from the ends of the top and bottom plates 310/320 and can span a desired length along the middle of the top and bottom plates 310/320. The desired length can be the same as or slightly longer than the width of the adjustable strap 120. By way of example, if the width of the adjustable strap is 1 inch, then the length of the recessed portions 314/324 can be 1.1 inches. In this manner, the adjustable strap 120 can fit within the recessed portions 314/324 to help secure the strap within the retention device 300 such that the strap is prevented from pulling through a tensioning device. The depth of the recessed portions 314/324 can also be selected such that the adjustable strap fits within the recessed portions. By way of example, if the adjustable strap 120 has a thickness of 0.2 inches, then the depth of the recessed portion 314 of the top plate 310 can be 0.1 inches and the depth of the recessed portion 324 of the bottom plate 320 can also be 0.1 inches. The depth of the recessed portions 314/324 can also be less than or greater than the thickness of the adjustable strap 120.

The recessed portions 314/324 can include a coating or layer of material that provides resistance to movement of the adjustable strap after the top and bottom plates 310/320 have been connected to each other. By way of example, a slip-resistant coating of a tacky substance; anti-slip tape type materials, foams, rubbers, or vinyl substances; or fabrics, such as velvet or neoprene, can be applied to the recessed portions 314/324 to assist in preventing the strap from pulling through a tensioning device. Other types of coatings or fabrics can also be used. If the top and/or bottom plates 310/320 do not include recessed portions, then a coating or layer of material can be applied to some or all of the interior surfaces of the top plate, the bottom plate, or the top and bottom plates.

Turning to FIG. 7, one or both of the interior surfaces 312/322 can include a plurality of protrusions 331 extending away from a plane of a protrusion area 330. Each of the plurality of protrusions 331 can be affixed at one end to the interior surface of the top and/or bottom plates and extend away from the surface terminating at a distal end. The protrusion area 330 can, but does not have to, span the entire area of the recessed portions 314/324. The top and bottom plates 310/320 can also be planarly flat and not include the recessed portions 314/324. According to this embodiment, the protrusion area 330 on the interior surfaces 312 and/or 322 can span some or all of the surface area of the interior surfaces.

The plurality of protrusions 331 for a given plate (i.e., the top plate or the bottom plate) can have a variety of spacing patterns and configurations. By way of example, a first row of protrusions can have a desired spacing distance from each other and span a desired length from each end of the plate. A second row of protrusions can be located adjacent to the first row and can have the same or different spacing pattern as the first row. More than two rows can also be included on a given plate's protrusion area 330. If a plurality of protrusions 331 are located on the interior surfaces 312/322 of both the top and bottom plates 310/320, then the location of the plurality of protrusions on the top plate 310 can be offset from the location of the plurality of protrusions on the bottom plate 320. In this manner, the distal ends of the protrusions extending away from the interior surface 312 of the top plate 310 do not align with the distal ends of the protrusions extending away from the interior surface 322 of the bottom plate 320. Accordingly, when the top plate 310 is connected to the bottom plate 320 with the adjustable strap 120 being located between the top and bottom plates 310/320, then the distal ends of the plurality of protrusions 331 from both plates can penetrate a certain depth into the first side and second side of the portion of the adjustable strap and not hit each other. The height of the plurality of protrusions 331 can also be selected such that the protrusions on the bottom plate 320 are not longer than the depth of the recessed portion 314 of the top plate 310 and vice versa. While the plurality of protrusions 331 are shown in the drawings as being pyramidal in shape, other shapes, such as needle-like or conical can also be used. According to any of the embodiments, the shape, spacing pattern, and material of the protrusions are selected such that the distal ends of the plurality of protrusions 331 penetrate a desired depth into the adjustable strap 120.

The exterior surfaces 313/323 can have straight sides with 90° angles. The exterior surfaces 313/323 can also include sides or edges that are angled with angles being less than 90°, for example, as shown in FIGS. 5A, 6, and 7. Each of the top and bottom plates 310/320 can have a thickness defined as the distance between the interior surfaces 312/322 and the exterior surfaces 313/323. The thickness of the top and bottom plates 310/320 can be the same or different. The thickness of the top and bottom plates 310/320 can be selected based on the thickness of the adjustable strap. According to any of the embodiments, the summation of the thickness of the top plate 310 and the thickness of the bottom plate 320 is greater than or equal to the thickness of the adjustable strap 120. By way of example, if the adjustable strap has a thickness of 0.1 inch, then the thickness of each of the top and bottom plates 310/320 can be 0.05 inch. The summation of the thickness of the top and bottom plates can also be less than the thickness of the adjustable strap. The thickness of the top and bottom plates 310/320 can also be selected such that the adjustable strap is prevented from pulling through a tensioning device. Thicker top and bottom plates can be used with thicker or wider straps where increased structural integrity of the retention device may be needed. By way of example, if the retention device is to be used to secure cargo during transport and the adjustable strap is large, then the thickness of the top and bottom plates may need to be much thicker than the thickness of plates used for straps of a fanny pack. The material the top and bottom plates are made from may also need to be selected based on the intended use. For securing cargo, for example, the plates can be made from a more durable material such as metals or metal alloys instead of a semi-rigid plastic.

The retention device 300 can include a connector. The connector can be used to connect the top plate 310 to the bottom plate 320. The connection can occur after a portion of the adjustable strap 120 is placed between the interior surfaces 312/322 of the top plate 310 and the bottom plate 320. The retention device 300 can be attached to any portion of the adjustable strap, for example, anywhere along length L located between the free end 121 of the adjustable strap 120 and the tensioning device 112 as depicted with reference to a tie-down strap 100 in FIG. 3 or directly underneath the tensioning device 112 as depicted for the backpack 200 in FIGS. 4A and 4B.

According to any of the embodiments, the connector is shown in FIGS. 5A-6 as including two screws (shown in FIGS. 4A and 4B) and screw holes. The top plate 310 can include an insertion hole 315 located at one end that traverses from the exterior surface 313 through to the interior surface 312. The top plate 310 can also include a receiving hole 316 as shown in FIG. 6 located at the other end that traverses partially into the body from the interior surface 312. The bottom plate 320 can include an insertion hole 325 located at one end that traverses from the exterior surface 323 through to the interior surface 322. The bottom plate 320 can also include a receiving hole 326 as shown in FIG. 5B located at the other end that traverses partially into the body from the interior surface 322. The insertion holes 315/325 can taper from the exterior surfaces 313/323 to the interior surfaces 312/322. The size of the insertion holes 315/325 and the amount of taper can be selected to correspond to the size and taper of a head of a flat head screw. Other types of screws can also be used instead of a flat head screw. The screws can have a variety of dimensions. The receiving holes 316/326 can be sized to correspond to the outer diameter of threads of the screws. All or a portion of the inside of the insertion holes 315/325 can include female threads. Preferably, the entire inside of the receiving holes 316/326 include female threads. The female threads can match the profile of male threads on the screws. According to another embodiment, female threads are not included, and the screws are self-tapping screws.

According to another embodiment, the receiving holes 316/326 and the insertion holes 315/325 traverse from the exterior surfaces 313/323 all the way through the interior surfaces 312/322. According to this embodiment, bolts and nuts (not shown) can be used instead of screws. A bolt can be placed through the insertion hole 315 of the top plate 310 and through the receiving hole 326 of the bottom plate 320 and a nut can be threaded onto the bolt. Another bolt can be placed through the insertion hole 325 of the bottom plate 320 and through the receiving hole 316 of the top plate 310 and a nut can be threaded onto the bolt. The diameter of the insertion holes 315/325 and receiving holes 316/326 can be greater than the outer diameter of the bolts used.

In order to connect the top plate 310 to the bottom plate 320, methods can include positioning first side of a portion of the adjustable strap 120 onto the interior surface 312 of the top plate 310. The methods can then include positioning the interior surface 322 of the bottom plate 320 on top of the second side of the portion of the adjustable strap. According to this example, the top plate 310 is positioned over the bottom plate 320 such that the insertion hole 315 of the top plate 310 aligns with the receiving hole 326 of the bottom plate 320, and the receiving hole 316 of the top plate 310 aligns with the insertion hole 325 of the bottom plate 320, for example as shown in FIG. 6. The methods can further include inserting a first screw into the insertion hole 315 of the top plate 310 and screwing the screw into the receiving hole 326 of the bottom plate 320. The methods can include flipping the retention device 300 over to expose the insertion hole of the bottom plate and inserting a second screw into the insertion hole 325 of the bottom plate 320 and screwing the screw into the receiving hole 316 of the top plate 310. The sequence of connecting the top plate 310 to the bottom plate 320 with two screws can be different and will differ if nuts and bolts are used.

Figure 8:
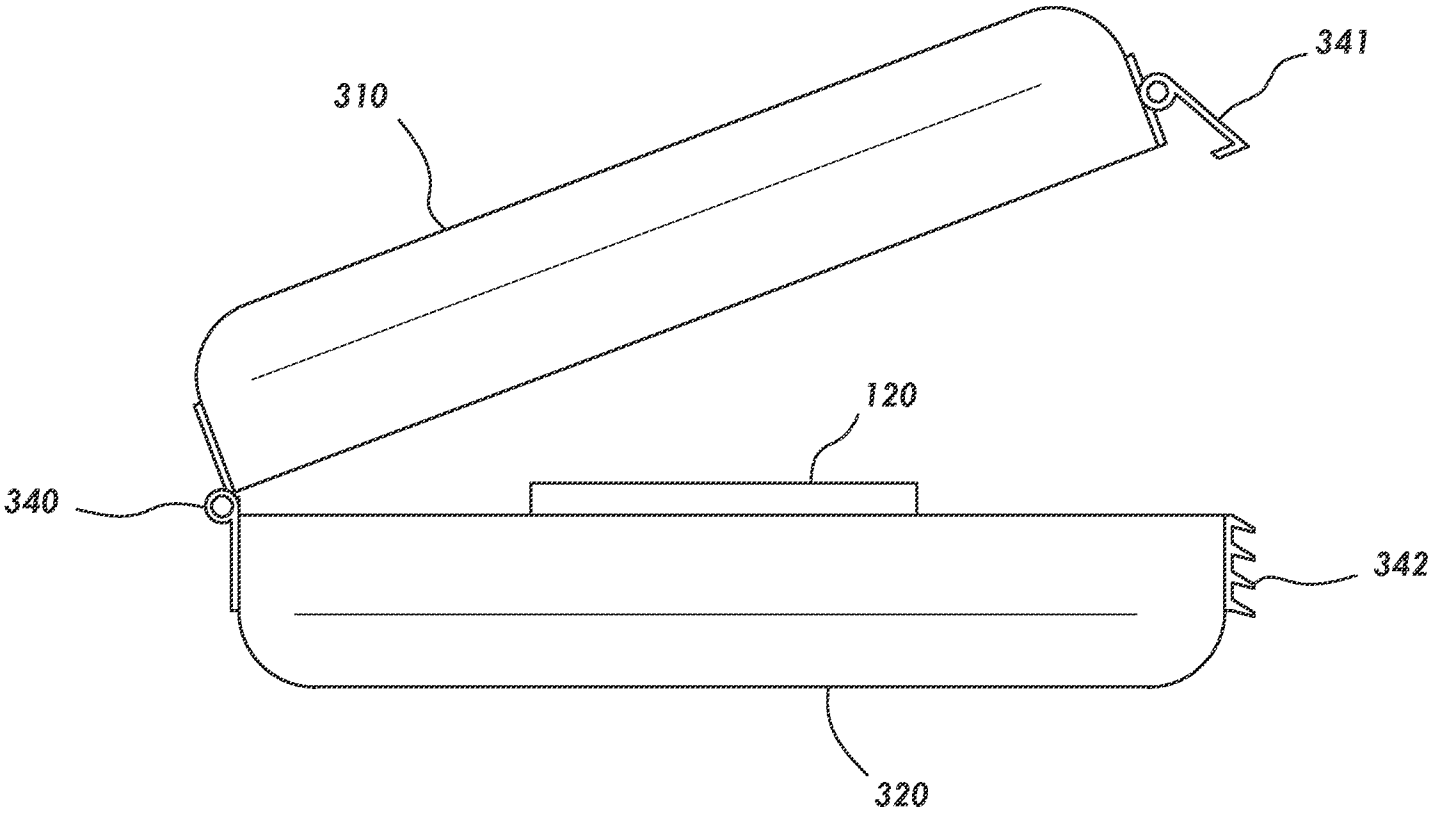
FIG. 8 is a side view of the retention device showing a different connector according to certain other embodiments.

Other connectors can be used instead of holes and screws or nuts and bolts. Another example connector is shown in FIG. 8. A first end of the top plate 310 and bottom plate 320 can be permanently connected via a hinge 340. A second end that is located opposite of the first end of the bottom plate 320 can include one or more latch receivers 342. The one or more latch receivers 342 can protrude from the second end and can be angled in a downwardly direction away from the hinge point. A second end of the top plate 310 that is located opposite of the first end can include a latch 341. The latch 341 can have a hook at the end as shown that connects to the one or more latch receivers 342. The methods can include positioning a second side of a portion of the adjustable strap 120 onto the interior surface 322 of the bottom plate 320. The methods can include moving the top plate 310 towards the bottom plate 320 via the hinge 340 and applying pressure such that the latch 341 engages with and temporarily locks to one of the latch receivers 342.

Connection of the top plate 310 to the bottom plate 320 via the connector can secure the portion of the adjustable strap within the retention device 300 such that the adjustable strap is prevented from pulling through a tensioning device. Because the retention device 300 is attached to the adjustable strap at a location between a free end and the tensioning device (e.g., the free end 121 of the adjustable strap 120 and the tensioning device 112 shown in FIG. 3 or the free end 213 of the adjustable strap 212 and the tensioning device 112 shown in FIG. 4A), even with force applied, the free end of the adjustable strap is prevented from pulling through the tensioning device. If the retention device is connected directly adjacent to the tensioning device 112, for example as shown in FIG. 4B, then the retention device 300 can prevent any substantial movement of the adjustable strap 120 through the tensioning device 112 whereby slack in the strap could occur.

The retention device 300 can also include other components. As shown in FIGS. 5A-6, the top plate 310 can include a hook 311 extending away from the end of the top plate that is adjacent to the receiving hole 316, and the bottom plate 320 can include a hook 321 extending away from the end of the bottom plate that is adjacent to the receiving hole 326. The hooks can be located at opposite ends of the top and bottom plates 310/320 after the plates are connected to each other to secure the adjustable strap. The hooks 311/321 can be curved as shown in the Figures or can be other shapes, for example, T-shaped, U-shaped (as shown in FIG. 4B), or triangle-shaped. A piece of elastic material (not shown), for example a bungee cord or shock cord, can be removably attached to the hooks 311/321 across the exterior surfaces 313/323 of the top plate 310 or the bottom plate 320. The elastic material can be used to secure excess length of the adjustable strap after the top and bottom plates 310/320 have been connected to each other.

Figure 9A:
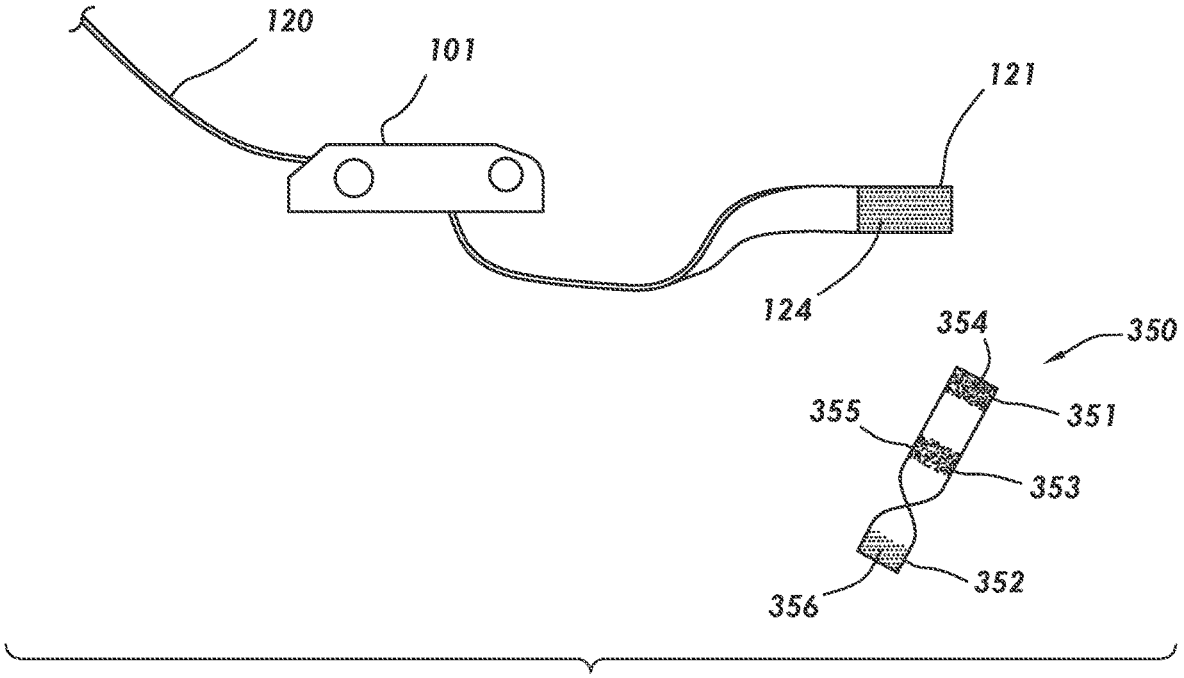
FIGS. 9A and 9B are top and side, cross-sectional views of the retention device according to certain other embodiments.
Figure 9B:
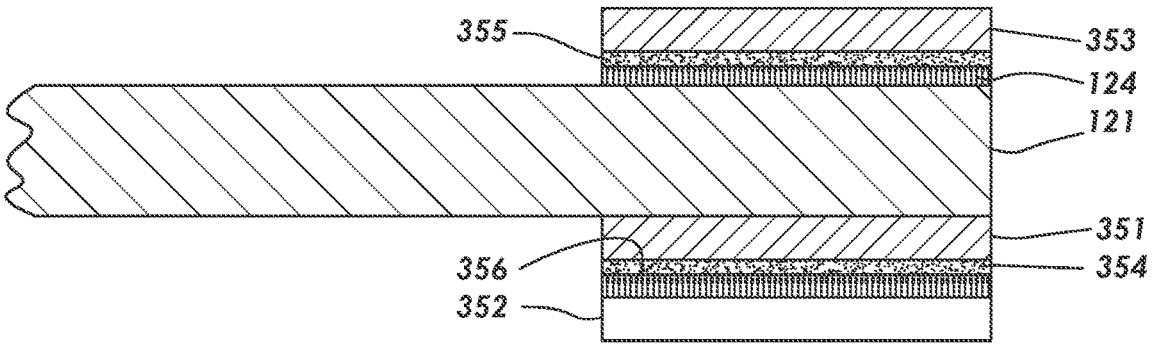

FIGS. 9A and 9B show a retention device according to other embodiments. The retention device can include a strip of material 350. The strip of material 350 can include a first end 351, a middle portion 353, and a second end 352. A portion of the adjustable strap 120, for example, the free end 213 or 121, can include a plurality of tiny flexible hooks 124 located on a first side. An entire section of the free end of the adjustable strap can include the plurality of tiny flexible hooks 124. In this manner, a desired length of the adjustable strap 120 can be pulled through the tensioning device 112 in order to secure an object or adjust straps of a backpack or other device such that the retention device 300 can be placed directly next to the tensioning device 112.

The first end 351 can include a plurality of tiny loops 354. The middle portion 353 can include a plurality of tiny loops 355. The second end 352 can include a plurality of tiny flexible hooks 356. The plurality of tiny loops and tiny flexible hooks are commonly known by the tradename VELCRO®. When pressed together, the tiny loops adhere to the tiny flexible hooks and create a connection. The plurality of tiny loops 355 of the middle portion 353 are configured to adhere to the plurality of tiny flexible hooks 124 on the first side of the adjustable strap 120. The plurality of tiny loops 354 of the first end 351 are configured to adhere to the plurality of tiny flexible hooks 356 of the second end 352. As shown in FIGS. 9A and 9B, the plurality of tiny flexible hooks 356 can be located on the opposite side of the strip of material 350 from the plurality of tiny loops 354.

In practice, a desired length of the adjustable strap 120 can be pulled through the tensioning device 112. Preferably, the thickness of the plurality of tiny flexible hooks 124 on the adjustable strap 120 can be selected such that the free end of the strap can be pulled through the tensioning device 112 to secure the object or adjust the length of the adjustable straps. Once the desired length has been pulled through the tensioning device 112, the plurality of tiny loops 355 of the middle portion 353 of the strip of material 350 can be placed on top of the plurality of tiny flexible hooks 124 and pressed down to adhere the middle portion 353 of the strip of material 350 to the adjustable strap 120—preferably adjacent to the tensioning device 112 such that after the adherence, the adjustable strap 120 is prevented from pulling back through the tensioning device. Next, the first end 351 can be secured to the second end 352. This can be accomplished by folding the strip of material 350 together like a claim—in the case where the plurality of tiny flexible hooks 356 are located on the same side of the material as the plurality of tiny loops 354. The first end 351 can be folded around one edge and underneath the bottom side of the strap, and the second end 352 can be folder around the opposite edge and underneath the bottom side of the strap and connected together—in the case where the plurality of tiny flexible hooks 356 are located on the opposite side of the material as the plurality of tiny loops 354 as shown in the drawings. The first end 351 can be pressed together with the second end 352 to adhere the hooks and loops together. After the first end and second end are adhered together, the strip of material 350 prevents the free end of the adjustable strap 120 from pulling back through the tensioning device 112. It is to be understood that the corresponding hooks or loops can be reversed from the description above (e.g., the strap can include a plurality of tiny loops and the middle portion can include a plurality of tiny flexible hooks), so long as the strip of material 350 can be temporarily connected to a portion of the adjustable strap 120 and the first end 351 can be temporarily connected to the second end 352 to prevent the adjustable strap 120 from pulling back through the tensioning device 112.

When it is no longer desirable to secure the object or lengthen the straps on a backpack for example, the methods can include removing the retention device from the adjustable strap. The step of removing the retention device can include removing the screws or bolts from the insertion and receiving holes, separating the top plate from the bottom plate, and removing the adjustable strap from the retention device. The step of removing the retention device can also include applying an outward pressure on the latch to free the latch from engagement with the latch receiver, moving the top plate away from the bottom plate via the hinge, and removing the second strap from the retention device. The step of removing the retention device can also include disconnecting the first end of the strip of material from the second end by pulling the ends away from one another and disconnecting the strip of material from the adjustable strap by pulling the strip of material away from the strap.

The retention device can have a variety of dimensions. According to any of the embodiments, the length of the top plate 310 and bottom plate 320 as measured from end to end is greater than the width of the adjustable strap. In this manner, the entire width of the adjustable strap is retained within the retention device after the top plate is connected to the bottom plate. The length of the interior surfaces 312/322 of the top and bottom plates 310/320 can also be greater than or equal to the width of the adjustable strap. The width of an adjustable strap of a tie down strap system may be greater than the width of an adjustable strap of a backpack or fanny pack. Accordingly, the length of the top and bottom plates and their interior surfaces may be greater when the retention device is used for a tie down strap system versus a backpack or fanny pack. The length of the top and bottom plates 310/320 can be in the range of 1 to 10 inches. The length of the interior surfaces 312/322 can be in the range of 0.5 to 9 inches.

The retention device and all components thereof can be made from a variety of materials. The material for each component can be the same or different. Examples of materials for the retention device components include, but are not limited to, hard plastics, semi-rigid plastics, metals, metal alloys, or natural materials such as cellulose, reinforced cellulose, wood, pressed wood pulps, etc.

A tie down strap system can include a tie down strap and the retention device. The tie down strap can include the components shown in and discussed above relating to FIGS. 1-3. A backpack system can include a backpack and the retention device. The backpack can include the components shown in and discussed above relating to FIGS. 4A and 4B.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While the apparatus, systems, and methods are described in terms of "comprising," "containing," or "including" various components or steps, the apparatus, systems, and methods also can "consist essentially of" or "consist of" the various components and steps. It should also be understood that, as used herein, "first," "second," and "third" are assigned arbitrarily and are merely intended to differentiate between two or more plates, ends, screws, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A retention device for use with an adjustable strap, the retention device comprising:

a top plate, wherein the top plate comprises an interior surface and an exterior surface;

a bottom plate, wherein the bottom plate comprises an interior surface and an exterior surface, wherein the interior surface of the top plate comprises a plurality of protrusions extending away from a plane of a protrusion area and receives a first side of a portion of the adjustable strap, wherein the interior surface of the bottom plate comprises a plurality of protrusions extending away from a plane of a protrusion area, and wherein a location of the plurality of protrusions on the top plate are offset from a location of the plurality of protrusions on the bottom plate and receives a second side of the portion of the adjustable strap; and a connector, wherein the top plate and bottom plate are configured to be connected to each other via the connector to prevent the adjustable strap from pulling through a tensioning device.

2. The retention device according to claim 1, wherein the interior surface of the top plate comprises a recessed portion, the interior surface of the bottom plate comprises a recessed portion, or both the interior surface of the top plate and the interior surface of the bottom plate comprise a recessed portion.

3. The retention device according to claim 1, wherein a height of the plurality of protrusions of the top plate are not longer than a depth of a recessed portion of the bottom plate.

4. The retention device according to claim 1, wherein the connector comprises holes and two screws or two nuts and two bolts.

5. The retention device according to claim 4, wherein the top plate further comprises:

an insertion hole located at a first end that traverses from the exterior surface through to the interior surface; and a receiving hole located at a second end that fully or partially traverses from the interior surface to the exterior surface, and wherein the bottom plate further comprises:

an insertion hole located at a second end that traverses from the exterior surface through to the interior surface; and a receiving hole located at a first end that fully or partially traverses from the interior surface to the exterior surface.

6. The retention device according to claim 5, wherein the insertion holes of the top plate and the bottom plate taper from the exterior surfaces to the interior surfaces of the top plate and the bottom plate.

7. The retention device according to claim 5, wherein all or a portion of an inside of the insertion holes of the top plate and the bottom plate comprise female threads, wherein all of an inside of the receiving holes of the top plate and the bottom plate include female threads, and wherein the female threads correspond to male threads of the two screws.

8. The retention device according to claim 5, wherein the two screws are self-tapping screws.

9. The retention device according to claim 5, wherein a first of the two screws is configured to be inserted through the insertion hole of the top plate and into the receiving hole of the bottom plate, and wherein a second of the two screws is configured to be inserted through the insertion hole of the bottom plate and into the receiving hole of the top plate to connect the top plate to the bottom plate.

10. The retention device according to claim 5, wherein a first of the two bolts is configured to be inserted through the insertion hole of the top plate and through the receiving hole of the bottom plate, wherein a second of the two bolts is configured to be inserted through the insertion hole of the bottom plate and through the receiving hole of the top plate, and wherein a first of the two nuts is configured to be threaded onto an end of the first of the two bolts and a second of the two nuts is configured to be threaded onto an end of the second of the two bolts to connect the top plate to the bottom plate.

11. The retention device according to claim 5, wherein the top plate further comprises a hook extending away from the second end of the top plate, wherein the bottom plate further comprises a hook extending away from the first end of the bottom plate, and wherein the hooks are located at opposite ends of the top and bottom plates after the top and bottom plates are connected to each other via the connector.

12. The retention device according to claim 11, wherein the hook of the top plate is configured to receive a first end of an elastic material and the hook of the bottom plate is configured to receive a second end to the elastic material, and wherein the elastic material is configured to be removably attached to the hooks across the exterior surface of the top plate or the exterior surface of the bottom plate.

13. The retention device according to claim 1, wherein a length of the top plate and the bottom plate is greater than a width of the adjustable strap.

14. The retention device according to claim 1, wherein the retention device is made from a material selected from the group consisting of hard plastics, semi-rigid plastics, metals, metal alloys, natural materials, and combinations thereof.

15. The retention device according to claim 1, wherein the plurality of protrusions of the top plate and the plurality of protrusions of the bottom plate have a geometric shape selected from a pyramid.

* * * * *